US005396722A

United States Patent [19]

Ostrovsky

[11] Patent Number: 5,396,722

[45] Date of Patent: Mar. 14, 1995

[54] PICTURE FRAME MEMBERS

[76] Inventor: John Ostrovsky, Concord, Ontario, Canada

[21] Appl. No.: 26,679

[22] Filed: Mar. 5, 1993

[51] Int. Cl.[6] ..... G09F 1/12

[52] U.S. Cl. ..... 40/156

[58] Field of Search ..... 40/152, 152.1, 156, 40/158.1; 24/487, 547, 555

[56] References Cited

U.S. PATENT DOCUMENTS 4,237,632 12/1980 Segerstad ..... 40/156
4,512,095 4/1985 Seely ..... 40/156
4,702,025 10/1987 Mace ..... 40/152.1 X
4,974,351 12/1990 Ghislanzoni ..... 40/156 X

FOREIGN PATENT DOCUMENTS 2222523 3/1990 United Kingdom ..... 40/152

*Primary Examiner*—Kenneth J. Dorner
*Assistant Examiner*—Joanne Silbermann
*Attorney, Agent, or Firm*—Adrian Zahl

[57] ABSTRACT

A picture frame member is provided, having a releasable picture and backing board clip, the clip being adapted to grip the picture and mounting board independently of each other.

2 Claims, 2 Drawing Sheets

PICTURE FRAME MEMBERS

FIELD OF THE INVENTION

The present invention relates to a picture frame member for releasably engaging a flexible poster or picture that has not been mounted to a rigid backing board.

BACKGROUND OF THE INVENTION

Frames for use with unmounted pictures have typically applied various means to mount the picture within the frame. It is often desired as well to provide means to allow the easy replacement of the picture, for example where the frame is to be used to hold advertising materials. The term "picture" is used here to denote a relatively thin, flexible sheet bearing any kind of image, including a poster, advertising display, photograph, or the like.

Frames for use with small pictures typically integrate a rigid backing board with the frame, but this solution may be impractical in larger frames and doesn't provide the flexibility provided by individual frame members that may be assembled into a frame. Another solution has been to provide a spring-loaded clip to clamp both the backing board and the picture directly to the frame. This type of frame suffers the drawback that it may be difficult to replace the picture, and the clip may also tend to wrinkle the picture, since the force required to grip the backing board is greater than the force required to grip the picture. As well, this approach requires the use of a backing board of essentially the same size as the picture, which restricts the replaceability of pictures to be mounted within the frame.

BRIEF DESCRIPTION OF THE INVENTION

The present invention is a picture frame element adapted to engage a picture and a rigid picture backing board independently of each other. In its broadest aspect, the invention is a picture frame member comprising: an elongate base having a generally flat upper face adapted to support the backing board and having inner and outer edges facing towards and away from the middle of said picture, respectively; a clip support extending upwardly from said upper face above the plane of the frame; and a picture clip engaged to said clip support. The picture clip has first and second engagement means spaced apart from each other and adapted to grip the picture and backing board, respectively.

In a further aspect of the invention, the clip is pivotally engaged to the clip support partway between first and second ends of said clip, and the clip is provided with biasing means to bias the clip downwardly towards the backing board. The first and second ends comprise the first and second engagement means, respectively, of the clip and may be adapted to pressingly engage the picture and backing board, respectively.

In a further aspect of the invention, the clip is pivotally engaged to the clip support at a point lying partway between the second end of the clip and the midpoint between the first and second ends of the clip, in order to provide a greater downward force towards the second end of the clip than the first. The directional references "downwardly" and "upwardly" as used herein refer to a frame or frame member positioned horizontally, with the picture-receiving surface of the frame facing upwardly.

DETAILED DESCRIPTION OF THE PREFERRED EMBODIMENTS

Figure 1:
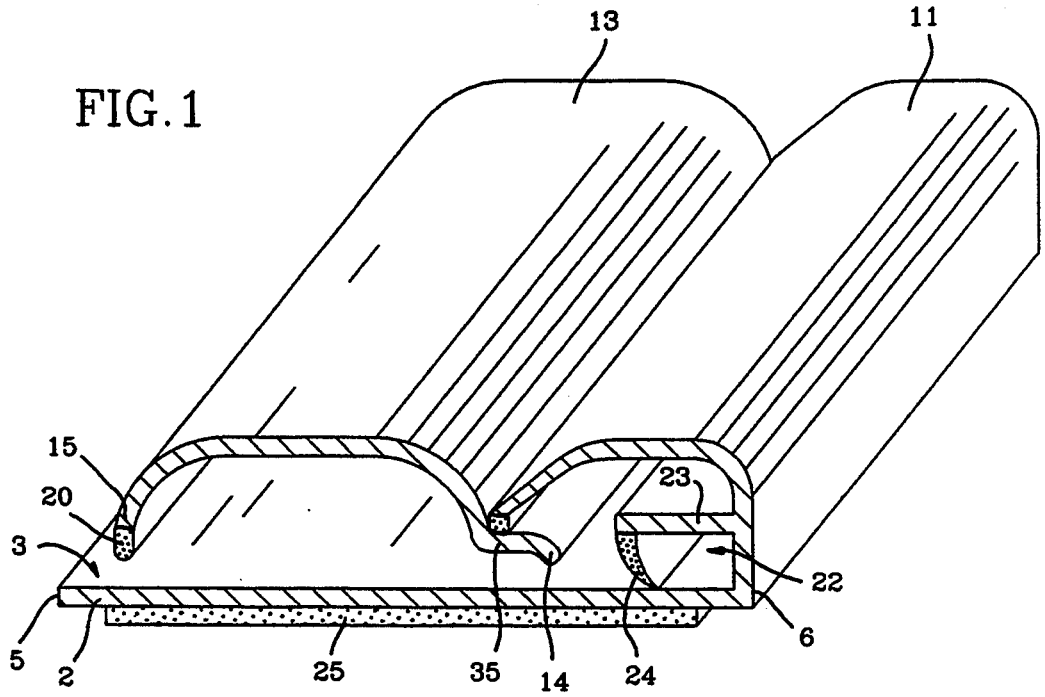
FIG. 1 is a perspective view of a picture frame according to the present invention.
Figure 2:
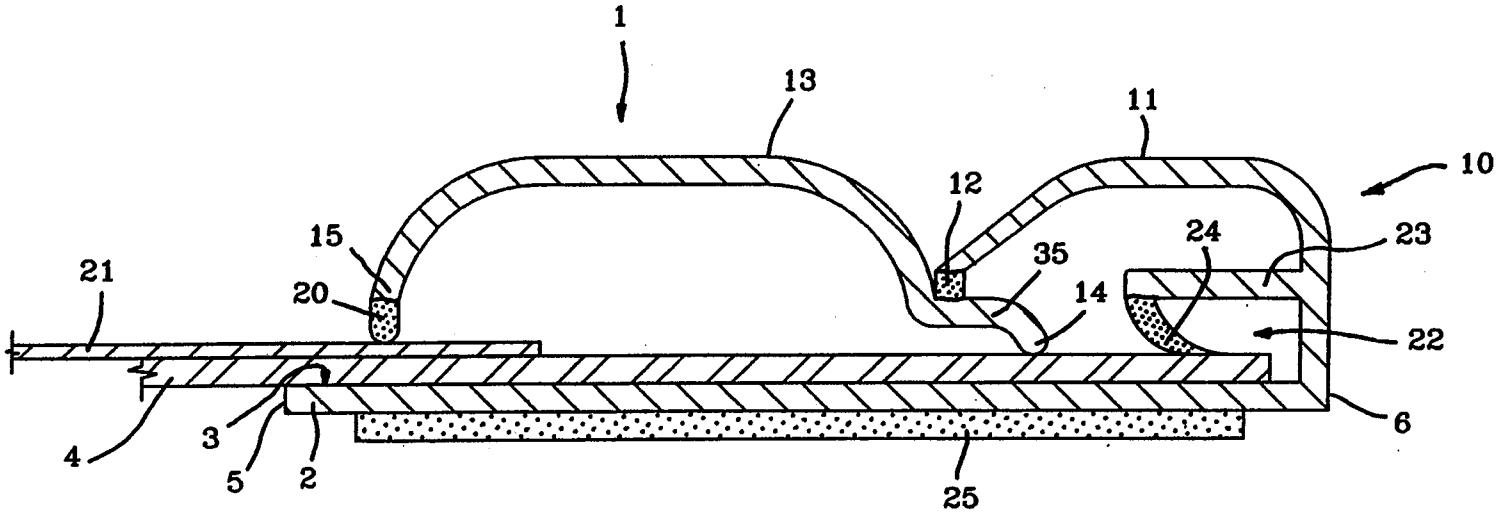
FIG. 2 is a side elevational view of the device, with a picture and backing board positioned within the frame member.

Referring to FIGS. 1 and 2, a picture frame member 1 comprises a base 2 having a flat upper surface 3 adapted to support a picture backing board 4, and inner and outer sides 5 and 6, facing the inside and outside of the frame, respectively. A clip support 10 is integral with the back and extends upwardly therefrom. The clip support has an arm 11 extending towards the inner side of the base 2, terminating in a hinge 12. The hinge 12 comprises a strip of flexible plastic glued to or co-extruded with the clip support. The clip support is fabricated of a resilient material, and biases the arm 11 downwardly.

The hinge 12 is glued to or co-extruded with a clip 13, and comprises an elongate body having the shape generally of an inverted "U", the longitudinal axis of which is parallel to the axis of the base. the clip has inner and outer sides facing the inside and outside of the frame, respectively. The outer side of the clip 13 has a heel 35 at the free margin thereof facing the outside of the frame, the heel 35 facing the outside of the frame. The clip 13 is provided with first and second downwardly depending edges 14 and 15, respectively. The first edge 14 comprises the free edge of the heel 35 and is adapted to pressingly engage the backing board. The inner side of the clip 13 terminates in a pliable contact strip 20 adapted to pressingly engage a picture 21.

The clip 13 is hinged to the clip support 10 at a point adjacent the first edge 14 of the clip. The clip accordingly applies a greater downward pressure on the first edge than the second edge, in order to grip the backing board 3 more firmly than the picture 21.

A backing board engagement member 22 protrudes inwardly from the clip support 10 and is integral therewith. The engagement member 22 comprises an elongate "U" shaped channel, the axis of which is parallel to the axis of the base. The channel faces inwardly from the outer edge of the base 2, and has a lower wall formed by a portion of the base 2 and an upper wall formed by a plate 23 extending inwardly from the clip support 10. A flexible, outwardly curved tongue 24 depends downwardly from the free edge of the plate 23, and is adapted to provide a one way engagement of the board 3, wherein the board may be inserted into the channel, but the outward curve of the tongue prevents the easy removal of the board. In use the backing board may be more or less permanently inserted into the frame.

The base, clip support and backing board engagement member may all be formed integrally of a single plastic extrusion.

An adhesive backing 25 is attached to the underside of the base 2 for attachment to a wall or other surface.

Figure 3:
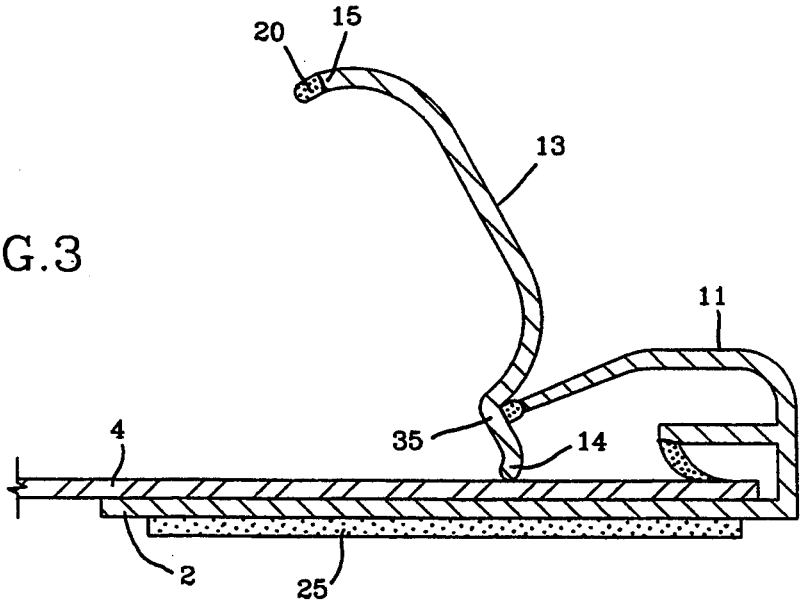
FIG. 3 is a side elevational view of the frame member shown in the open position.

Referring to FIG. 3, the clip 13 may be flipped upwards to replace the picture 21. In the open position illustrated here, the clip support is flexed upwardly, and the clip is held open by the pressure of the first end of the clip exerted against the backing board 3. When the clip has been flipped completely open, the heel 35 maintains it in the open position.

In use, a frame may be assembled by joining together four frame members at their ends, each of which may be bevelled at a 45 degree angle to form an attractive joint between abutting frame members. A picture may be mounted within the frame by flipping open all of the clips, removing the existing picture, and placing a new picture within the frame on top of the existing backing board. The picture should be smaller than the backing board, leaving a margin of backing board extending beyond the edges of the picture. The margin should be sufficient to allow the picture to be placed in the frame without being engaged by the first edge 14 of the clip. Once the picture has been positioned within the frame, the clips may be snapped back into the closed position. The downward pressure exerted on the clip by the clip support causes the first edge 14 of the clip to engage the board and the second edge 15 to engage the picture. The first edge, being closer to the hinge 12, applies greater pressure than does the second edge. Thus the board is tensioned with sufficient force against the base to hold it firmly in place, while less pressure is applied against the picture to avoid wrinkling or tearing. As well, the relatively long reach between the hinge 12 and the second edge 15 allows various size pictures to be mounted within the same frame without adjustment, and provides a wide decorative exposed face.

The present invention has been described by way of a preferred embodiment thereof. It will be understood by those skilled in the art that variations may be made thereto without departing from the spirit and scope of the invention, as defined in the appended claims.

I claim:

1. A picture frame member for the engagement of a flexible picture and a picture backing board, said frame member adapted to engage said picture and backing board independently of each other and comprising:

a) a base having a generally flat upper surface comprising a backing board support structure;

b) a clip above the upper surface of said base and comprising a generally channel-shaped strip having downwardly-facing first and second edges adapted to grippingly engage a picture and backing board, respectively, independently of each other;

c) a clip support structure linking said clip with said base and having biasing means to bias said clip support downwardly towards said base, wherein said clip is hinged to said clip support structure and adapted to rotate from an open position wherein said first edge is elevated from said base for the insertion of a picture, and a closed position wherein said first edge presses against said base, said clip having an over center engagement to said clip support structure such that said second edge is biased towards said base by said clip support structure by a greater amount than said forward edge; and d) a backing board grip member comprising a U-shaped channel for the insertion of a backing board therein, the longitudinal axis of which is parallel to the longitudinal axis of said base, said channel comprising upper and lower walls, the lower wall being comprised of said base and the upper wall extending from said clip support structure, at least one of said walls having a board engagement element facing the interior of the channel.

2. A picture frame member as claimed in claim 1 wherein said board engagement element comprises a flexible tongue depending downwardly from the upper wall of said backing board grip member.

* * * * *